US005454669A

United States Patent [19]

Oziem et al.

[11] Patent Number: 5,454,669

[45] Date of Patent: Oct. 3, 1995

[54] YIELD VALVE

[75] Inventors: Christopher J. Oziem; Stephen A. Brown, both of Cheltenham, England

[73] Assignee: Longwall Roof Supports Limited, Wigan, England

[21] Appl. No.: 177,996

[22] Filed: Jan. 6, 1994

[30] Foreign Application Priority Data

Jan. 13, 1993 [GB] United Kingdom ..... 9300544

[51] Int. Cl.[6] ..... E21D 23/16

[52] U.S. Cl. ..... 405/302; 405/291; 405/295

[58] Field of Search ..... 405/291, 295, 405/299, 296, 302; 91/170 MP; 137/494, 508, 509; 299/31, 33

[56] References Cited

U.S. PATENT DOCUMENTS

| | | | |
|---|---|---|---|
| 4,552,488 | 11/1985 | Elliott-Moore | 405/302 X |
| 4,936,714 | 6/1990 | Demircan | 405/302 |
| 5,073,067 | 12/1991 | Elliott-Moore | 405/302 |

FOREIGN PATENT DOCUMENTS 2243640 11/1991 United Kingdom .

*Primary Examiner*—David H. Corbin
*Attorney, Agent, or Firm*—Young & Thompson

[57] ABSTRACT

A yield valve comprises a valve body, a first inlet port, an outlet port, a valve seat, and a valve member movable between a first position in which it cooperates with the valve seat to prevent fluid communication between the inlet port and the outlet port and a second position in which the outlet port is brought into fluid communication with the inlet port. One side of the valve member is subjected to the pressure of fluid at the inlet port to urge the valve member towards its second position. Spring means acts on the other side of the valve member to urge the valve member towards its first position. The valve also has a valve chamber isolated from the inlet port and from the outlet port and a second inlet port for supplying a fluid under pressure to the chamber. The valve chamber is so arranged with respect to the valve member and the spring means that fluid pressure within the chamber will act on the valve member to urge the valve member towards its first position and will act on the spring means so as to reduce the force applied to the valve member by the spring means by an amount at least substantially equal to the force applied by the fluid pressure to the valve member.

11 Claims, 4 Drawing Sheets

YIELD VALVE

This invention relates to a yield valve particularly but not exclusively for use in combination with a mine roof support and also to a mine roof support including such a yield valve.

GB 2243640A discloses a yield valve in combination with a mine roof support. The mine roof support comprises a canopy, a base section, hydraulic props for raising and lowering the canopy relative to the base section, and a hydraulic valve for supplying hydraulic fluid under pressure to the props via a check valve. The yield valve is connected across the check valve and has a valve member movable between a first position in which it co-operates with a valve seat to prevent the release of fluid from the props via the yield valve and a second position in which fluid can be released from the props via the yield valve. One side of the valve member is subjected to fluid pressure downstream of the check valve to urge the valve member towards its second position and the other side of the valve member is acted upon by a spring device to urge the valve member towards its first position. The other side of the valve member and the spring device are also subjected to fluid pressure upstream of the check valve so that more and more of the spring force applied by the spring device is substituted by hydraulic force applied to the other side of the valve member by fluid pressure upstream of the check valve as the latter increases until the fluid pressure acting on the spring device balances the urging force thereof at a nominal yield pressure of the yield valve.

The yield valve disclosed in GB 2243640A suffers from the drawback that fluid released from the props when the yield valve cracks is discharged into the hydraulic pressure supply. Because the pressure drop across the yield valve is small, the physical size of the valve has to be large by comparison to a valve releasing fluid to low pressure. Also, in order to cope with large backflows from several yield valves, the pressure supply system would need to be excessively large. Moreover, the yield valve disclosed in GB 2243640A is not particularly versatile.

SUMMARY OF INVENTION

According to a first aspect of the present invention there is provided a yield valve comprising a valve body, a first inlet port, an outlet port, a valve seat, a valve member movable between a first position in which it co-operates with the valve seat to prevent fluid communication between the first inlet port and the outlet port and a second position in which the outlet port is brought into fluid communication with the first inlet port, one side of the valve member being in use subjected to the pressure of fluid at the first inlet port to urge the valve member towards its second position, spring means acting on the other side of the valve member to urge the valve member towards its first position, a valve chamber isolated from the first inlet port and from the outlet port, and a second inlet port for supplying a fluid under pressure to the valve chamber, the valve chamber being so arranged with respect to the valve member and the spring means that fluid pressure within the chamber will act on the valve member to urge the valve member towards its first position and will act on the spring means so as to reduce the force applied to the valve member by the spring means by an amount at least substantially equal to the force applied by the fluid pressure to the valve member.

Such a yield valve can be used in combination, for example, with a mine roof support to permit fluid released from the props to be discharged other than into the hydraulic fluid supply to the props. Also, a yield valve according to the first aspect of the invention is more versatile than that disclosed in GB2243640A in that the yield pressure of the valve can, if desired, be made independent of the pressure of the hydraulic fluid supply to the props by connecting the second inlet to an independent control pressure line.

Preferably, the spring means comprises a spring loaded plunger movable relative to the valve body in a direction parallel to the direction of movement of the valve member and a part of the valve member and a part of the spring loaded plunger extend into the chamber.

Preferably, the valve member and plunger extend through respective openings in a wall of the valve chamber and sealing means sealingly supports the valve member and plunger for slidable movement in its respective opening, the plunger being in use exposed externally of the chamber to a relatively low reference pressure.

In one embodiment, the area of the plunger exposed to fluid pressure in the valve chamber as measured in a plane normal to the direction of movement of the plunger is equal to the corresponding area of the valve member so that in use fluid pressure in the chamber will apply equal and opposite forces to the valve member and the plunger.

In another embodiment, the area of the plunger exposed to fluid pressure in the valve chamber as measured in a plane normal to the direction of movement of the plunger is greater than the corresponding area of the valve member so that in use the force applied by fluid pressure in the valve chamber to the plunger will be greater than, and in an opposite direction to, the force applied to the valve member. This allows the yield pressure of the valve to be reduced below a nominal value dictated by the urging force applied to the valve member, in the absence of fluid pressure in the valve chamber, by the spring means.

Conveniently, the plunger is spring loaded by a helical compression spring acting on the plunger via a force transmitting member externally of the valve chamber.

Advantageously, the spring means further comprises a spring in the valve chamber which spring applies a relatively weak force to the valve member by comparison to the full force applied to the valve member by the spring loaded plunger. This ensures that the yield valve will reset when fluid pressure at the first inlet port drops below the yield pressure of the valve.

Conveniently, the valve member is in the form of a piston which is slidably mounted in the valve seat, the valve member having one or more holes in its surface which co-operates with the valve seat, the holes or holes being in communication with the first inlet port via a passage in the valve member.

According to a second aspect of the invention there is provided a mine roof support comprising a roof engageable canopy, a floor engaging base section, prop means for raising and lowering the canopy relative to the base section and for setting the canopy against a mine roof, means for supplying hydraulic fluid under pressure to the prop means via a check valve (as defined herein), a yield valve according to the first aspect of the invention, means connecting the first inlet port of the yield valve to the hydraulic fluid supply means downstream of the check valve, and means connecting the second inlet port of the yield valve to the hydraulic fluid supply means upstream of the check valve.

According to a third aspect of the invention there is provided a mine roof support comprising a roof engageable canopy, a floor engaging base section, prop means for raising and lowering the canopy relative to the base section and for setting the canopy against a mine roof, means for supplying hydraulic fluid to the prop means, a yield valve according to the first aspect of the invention, means connecting the hydraulic fluid supply means to the first inlet port of the yield valve and means for supplying a control pressure to the second inlet port of the yield valve.

According to a fourth aspect of the invention there is provided a mine roof support comprising a roof engageable canopy, a floor engaging base section, prop means for raising and lowering the canopy relative to the base section and for setting the canopy against a mine roof, means for supplying hydraulic fluid under pressure to the prop means, and a yield valve having an outlet port through which fluid from the prop means can be released, a valve seat, a valve member movable between a first position in which it co-operates with the valve seat to prevent the release of fluid from the prop means via the outlet port and a second position in which fluid can be released from the prop means via the outlet port, means for subjecting one side of the valve member to the pressure of fluid in the prop means to urge the valve member towards its second position, spring means acting on the other side of the valve member to urge the valve member towards its first position, and means isolated from the outlet port for subjecting the other side of the valve member and the spring means to a pressurised fluid so that an increasing amount of the spring force applied to the valve member by the spring means is substituted by force applied to the other side of the valve member by the pressurised fluid as the latter increases.

The check valve can be a non-return valve or a pilot operated check valve which functions as a non-return valve except when released such as by applying pressure to a pilot line, and the term "check valve" as used herein embraces these valves and any equivalents thereof.

The invention will now be more particularly described, by way of example, with reference to the accompanying drawings.

A BRIEF DESCRIPTION OF THE DRAWINGS

FIG. 1 is a side view of a mine roof support embodying the present invention, FIG. 2 shows one example of an hydraulic circuit used for operating the hydraulic props of the roof support shown in FIG. 1, FIG. 3 is a sectional view of one embodiment of the yield valve of FIG. 2, shown on an enlarged scale, and FIG. 4 shows another example of an hydraulic circuit used for operating the hydraulic props of the roof support shown in FIG. 1.

DESCRIPTION OF THE PREFERRED EMBODIMENTS

Figure 1:
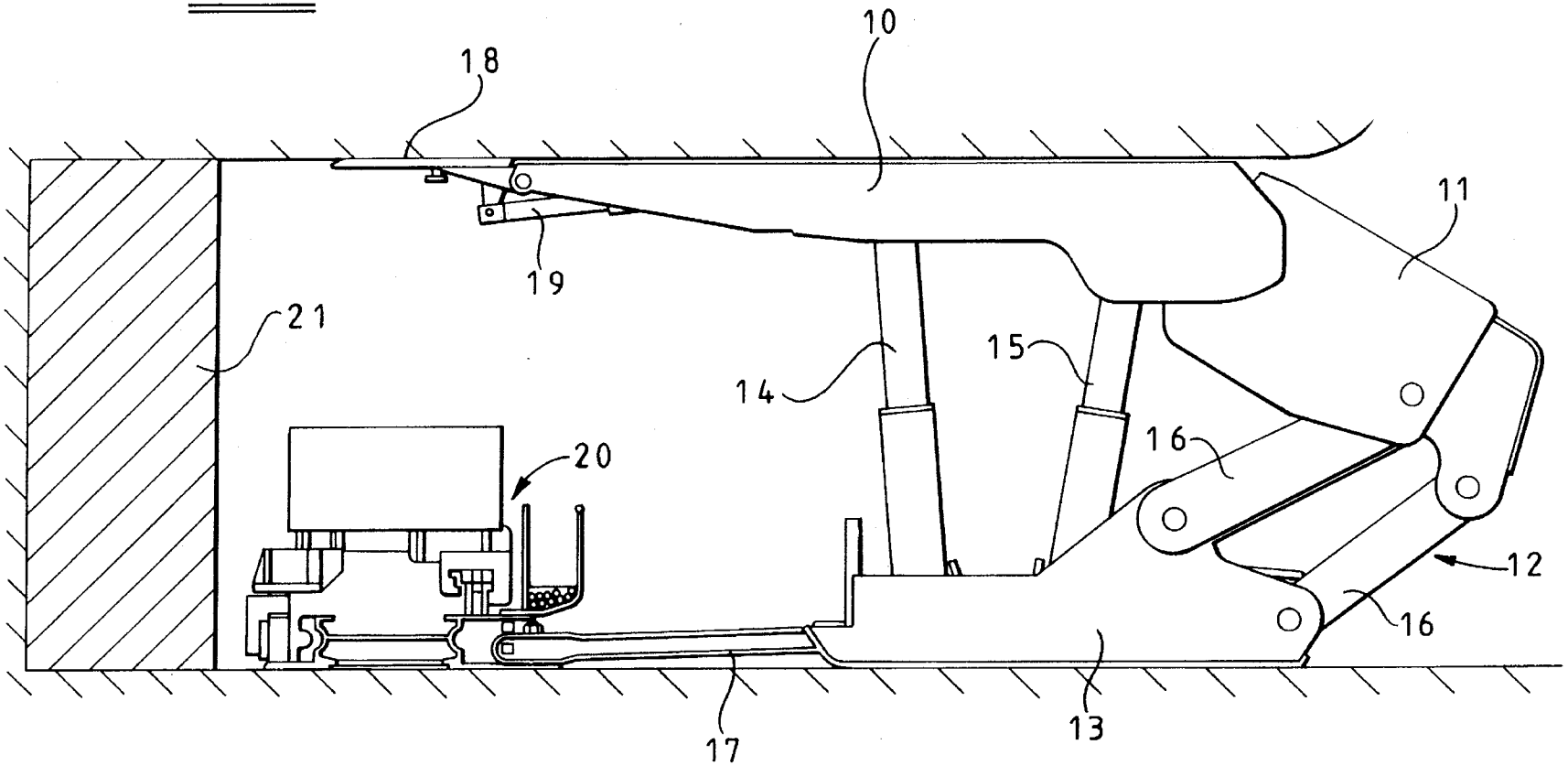

Referring firstly to FIG. 1 of the drawings, the roof support shown therein comprises a canopy 10, a shield section 11, a lemniscate linkage arrangement 12, a base section 13 comprising two spaced apart pontoons, a pair of front hydraulic props 14, and a pair of rear hydraulic props 15.

The shield section 11 is pivotally connected at one end to the rear (goaf) end of the canopy, and the lemniscate linkage arrangement 12, which includes four links 16, is pivotally connected at one end to the other end of the shield section 11, and at the other end to the pontoons making up the base section 13.

The roof support also comprises an advancing mechanism in the space between the two pontoon members, the advancing mechanism comprising a relay bar arrangement 17, and an advancing ram (not shown) connected between the relay bar arrangement 17 and the base section 13.

The rear props 15 are pivotally connected at their lower ends to respective pontoons of the base section 13 and are pivotally connected at their upper ends to the canopy 10 at positions adjacent to the rear end thereof. The front props 14 are also pivotally connected at their lower ends to respective pontoons of the base section 13 and are pivotally connected at their upper ends to the canopy 10 at positions intermediate the ends thereof.

A canopy extension 18, commonly referred to in the art as a tip, is hingedly connected to the front end of the canopy 10 so as to be angularly adjustable relative to the canopy by an hydraulic piston and cylinder unit 19.

The relay bar arrangement is connected to a conveyor 20 which is arranged in juxtaposition to the mine face or seam 21.

Figure 2:
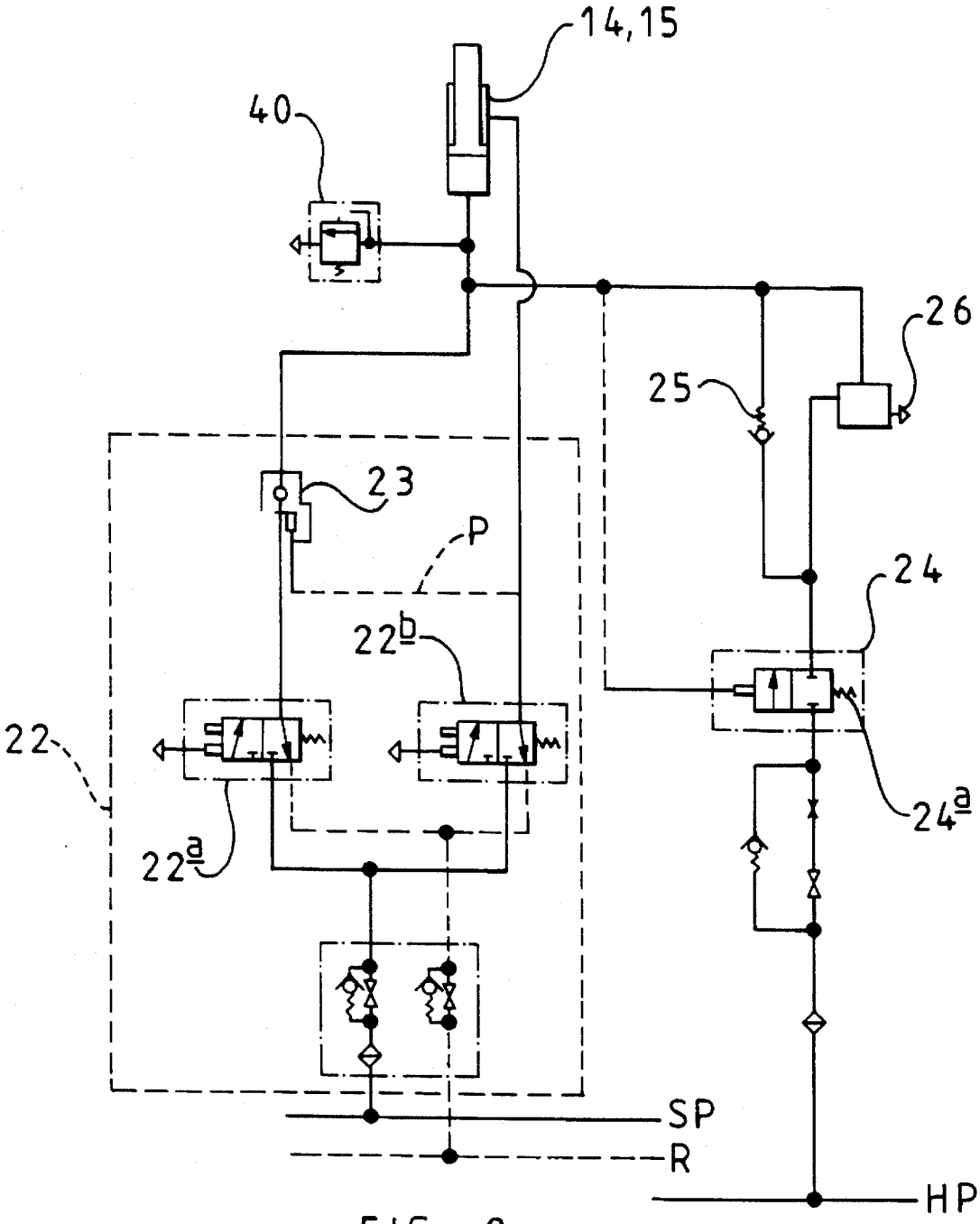

Referring now to FIG. 2, this shows one of the props 14, 15, and an hydraulic circuit for operating that prop. The circuit comprises a known valve arrangement 22 including a set control valve 22*a* for selectively connecting the hydraulic prop 14, 15 to a source of pressurised fluid SP and to a fluid reservoir R, and a release control valve 22*b* connected to the annulus of the prop. The valve arrangement 22 includes a pilot operated check valve 23 which functions as a non-return valve except when released by the application of pressure to a pilot line P.

The hydraulic fluid source SP is common to a number of mine roof supports which are advanced and set in turn. The pressure of the hydraulic fluid source SP is known as the system pressure, and is typically of the order of 3000 psi (20600 $kN/m^2$).

This system pressure can drop due to a large drain on the source SP as the roof supports are advanced and set with the result that the roof supports may be set at somewhat below their intended setting value. To prevent this happening, there is also a guaranteed set valve 24 which, when operated, connects the prop 14, 15 to a source of hydraulic fluid HP, supplied by a small capacity pump at a pressure higher than the system pressure. The valve 24 is a pilot operated valve which is urged towards a closed condition by a spring 24*a* and which is moved to an open condition by fluid pressure acting on a pilot piston against the urging force of the spring. The valve 24 is operable in response to the pressure in the hydraulic prop 14, 15 and moves to an open condition when the pressure in the prop exceeds a predetermined value. The value 24 is connected to the hydraulic prop 14, 15 via a check valve in the form of a non-return valve 25 and a yield valve 26 is connected across the non-return valve 25. There is also a safety valve 40.

Figure 3:
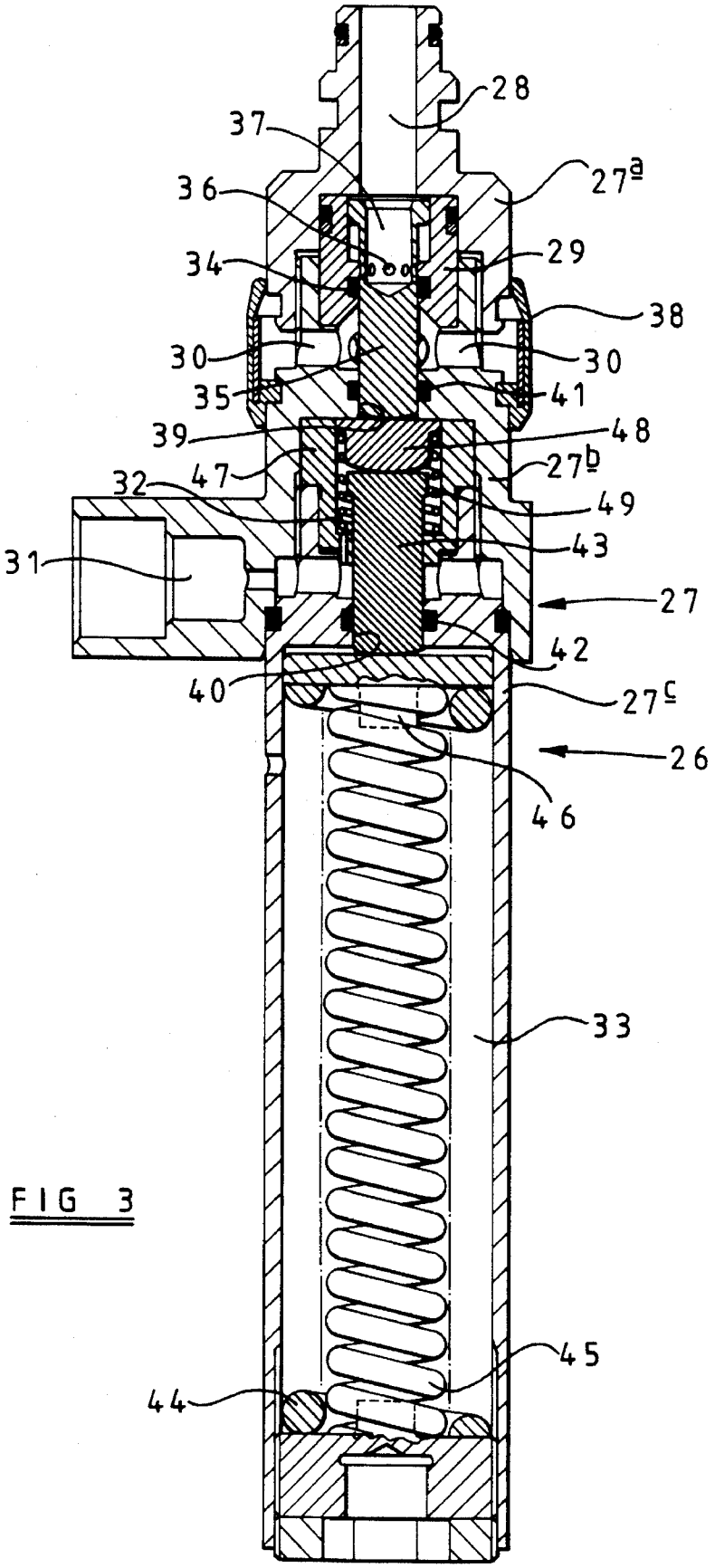

The yield valve 26 will now be more particularly described with reference to FIG. 3. The valve 26 includes a valve body 27 comprising parts 27*a*, 27*b* and 27*c*. Part 27*a* defines a first inlet port 28 and, together with part 27*b*, a chamber for a seat carrier 29. Part 27*b* also defines outlet ports 30, a second inlet port 31 and, together with part 27*c*, a control chamber 32. Part 27*c* also defines a spring chamber 33 exposed to atmospheric or some other low reference pressure.

The seat carrier 29 is in the form of a bush having a stepped, cylindrical through-bore therein and carries a seat 34 in the form of an O-ring which is mounted in an annular groove in the wall of the throughbore.

A valve member 35 in the form of an elongate piston is slidably mounted in the seat 34. The valve member 35 has one or more apertures 36 in its peripheral surface and these apertures communicate with a passage 37 within the valve member 35. The passage 37 communicates with the first inlet port 28 and the side of the valve seat 34 remote from the first inlet port 28 communicates with the outlet ports 30.

The outlet ports 30 extend radially through the part 27*b* of the valve body and are surrounded by a shroud 38 which is attached at its lower end to the part 27*b* and which flexes outwardly at its upper end under fluid pressure at the outlet ports 30 to deflect any fluid flowing through the yield valve in a generally axial direction along the body part 27*a*.

The control chamber 32 has openings 39 and 40 at opposite ends respectively. An O-ring seal 41 is mounted in an annular groove in the wall of the opening 39 and the valve member 35 extends beyond the outlet ports 30 and into the opening 39 where it makes sealing contact with the seal 41. An O-ring seal 42 is mounted in an annular groove in the wall of the opening 40 and a plunger 43 is slidably mounted in the opening 40 in sealing contact with the seal 42 and projects into the control chamber 32. The plunger 43 is urged towards the valve member 35 by two compression springs 44 and 45 which are housed in the spring chamber 33 and which act on the plunger via a force transmitting member 46.

In the embodiment shown in FIG. 2, the first inlet port 28 of the yield valve 26 communicates with hydraulic fluid downstream of the non-return valve 25 (i.e. with the fluid pressure in the prop 14, 15) and the second inlet port 31 communicates with hydraulic fluid upstream of the non-return valve 25.

In order to set the canopy, the valve arrangement 22 is first operated so that pressurised fluid is supplied to the prop 14, 15 from the source SP. The canopy 10 will rise and make contact with the mine roof. Provided the mine roof is sound, the canopy 10 will set against the roof at a pressure corresponding to the system pressure supplied from the source SP. Although, the system pressure may be less than its full value owing to the large drain on the source SP, it will be more than adequate to open the guaranteed set valve 24 and there will then be a constant supply of high pressure fluid from the source HP to the prop 14, 15, via the non-return valve 25. Hydraulic fluid will enter the control chamber 32 of the yield valve 26 via the second inlet port 31 and will pass around the plunger 43 and force transmitting member 48. The hydraulic fluid within the control chamber 32 acts on the plunger 43 to provide a net force which opposes the urging force of the springs 44 and 45 and the hydraulic fluid within the control chamber 32 applies an opposite force to the valve member 35. The valve member 35 is also acted upon by the pressure of hydraulic fluid downstream of the non-return valve 25 and the forces applied to opposite sides of the valve member 35 by fluid pressure upstream and downstream of the non-return valve 25 will be equal and opposite provided that the upstream and downstream pressures are also equal. Thus, whilst the upstream and downstream pressures are equal the hydraulic pressure acting on opposite sides of the valve member 35 will be balanced, and the urging force of the springs 44 and 45 will progressively decrease to zero as the upstream pressure increases.

In the yield valve 26 as shown, the area bounded by the valve seat 34 is equal to the area bounded by the seal 41 and less than the area bounded by the seal 42. Thus the fluid pressure in the control chamber 32 will apply a greater force to the plunger 43 than to the valve member 35. Hence, the urging force of the springs 44 and 45 will be balanced by fluid pressure in the control chamber 32 when the pressure in the control chamber is less than the nominal yield pressure of the yield valve as dictated by the full urging force of the springs 44 and 45 with no fluid pressure in the control chamber 32.

This is of particular advantage when, in an alternative and sometimes preferred embodiment, the second inlet port is connected to a separate control line instead of to the upstream side of the non return valve 25. In this case, the yield pressure of the valve 26 can be varied by varying the pressure of fluid in the control line. Also, in this case, not all roof supports need to be set to yield at the same pressure.

With a yield valve as hereinbefore described, the average pressure of fluid supplied from the source HP can be at (or close to) yield pressure without risking premature failure of the yield valve.

If the hydraulic prop 14, 15 is set to the yield pressure of the valve 26, fluid pressure at the inlet port 28 will be balanced by the fluid pressure in the control chamber 32 and the valve member 35 will remain closed as a result of friction. However, if the mine roof moves to increase the pressure in the prop 14, 15, the valve member 35 will move to discharge fluid from the prop 14, 15 via the outlet ports 30 as the pressure at the inlet port 28 (i.e. downstream of the non-return valve 25) will be greater than the pressure of fluid in the control chamber 32.

If the second inlet port 31 communicates as shown with fluid pressure upstream of the non-return valve 25 rather than with a separate control line and if the pressure of source HP rises above the nominal yield pressure of the valve 26 and then falls, the valve 26 will yield but the pressure drop across the seat 34 will be low and there will be no significant damage to the yield valve.

The weak spring 49 is provided to close the yield valve particularly when the control chamber 32 communicates with fluid pressure upstream of the non-return valve 25 as otherwise the yield valve when opened would remain open with fluid pressure on opposite sides of the valve member 35 equal. As an alternative to the weak spring 49, the area bounded by the seal 41 could be made slightly greater than the area bounded by the valve seat 34. In this case, the valve member 35 would need to have a slightly larger diameter at its end remote from the first inlet port 28 in order to co-operate with the seal 41.

If the pressure in the control chamber 32 falls to zero, the yield valve 26 will act in a conventional manner and will release fluid from the prop when the fluid pressure therein exceeds the nominal yield pressure of the valve 26 by overcoming the full urging force of the springs 44 and 45.

In some circumstances it may be desirable to provide a yield valve which never yields below its nominal yield pressure as dictated by the full urging force of the springs 44 and 45. This can be made possible by using a plunger 43 of equal diameter to the valve member 35 and by ensuring that the area bounded by the seal 41 equals the area bounded by the seal 42 as measured in a plane perpendicular to the direction of movement of the valve member 35 and the plunger 43. In this case, fluid pressure in the control chamber 32 will balance the urging force of the springs 44 and 45 when the fluid pressure in the chamber 32 equates to the nominal yield pressure of the valve.

Only one prop 14, 15 is shown in FIG. 2. The circuit shown in FIG. 2 may service all props 14, 15 simultaneously or, by way of example, the two front props 14 could be serviced by one hydraulic circuit and the two rear props 15 by a similar but separate hydraulic circuit.

Also, the props 14, 15 could be set to the system pressure by supplying the guaranteed set valve 24 from the source SP instead of the separate high pressure source HP. In this case, the full system pressure may be equivalent to the yield pressure of the valve 26.

Figure 4:
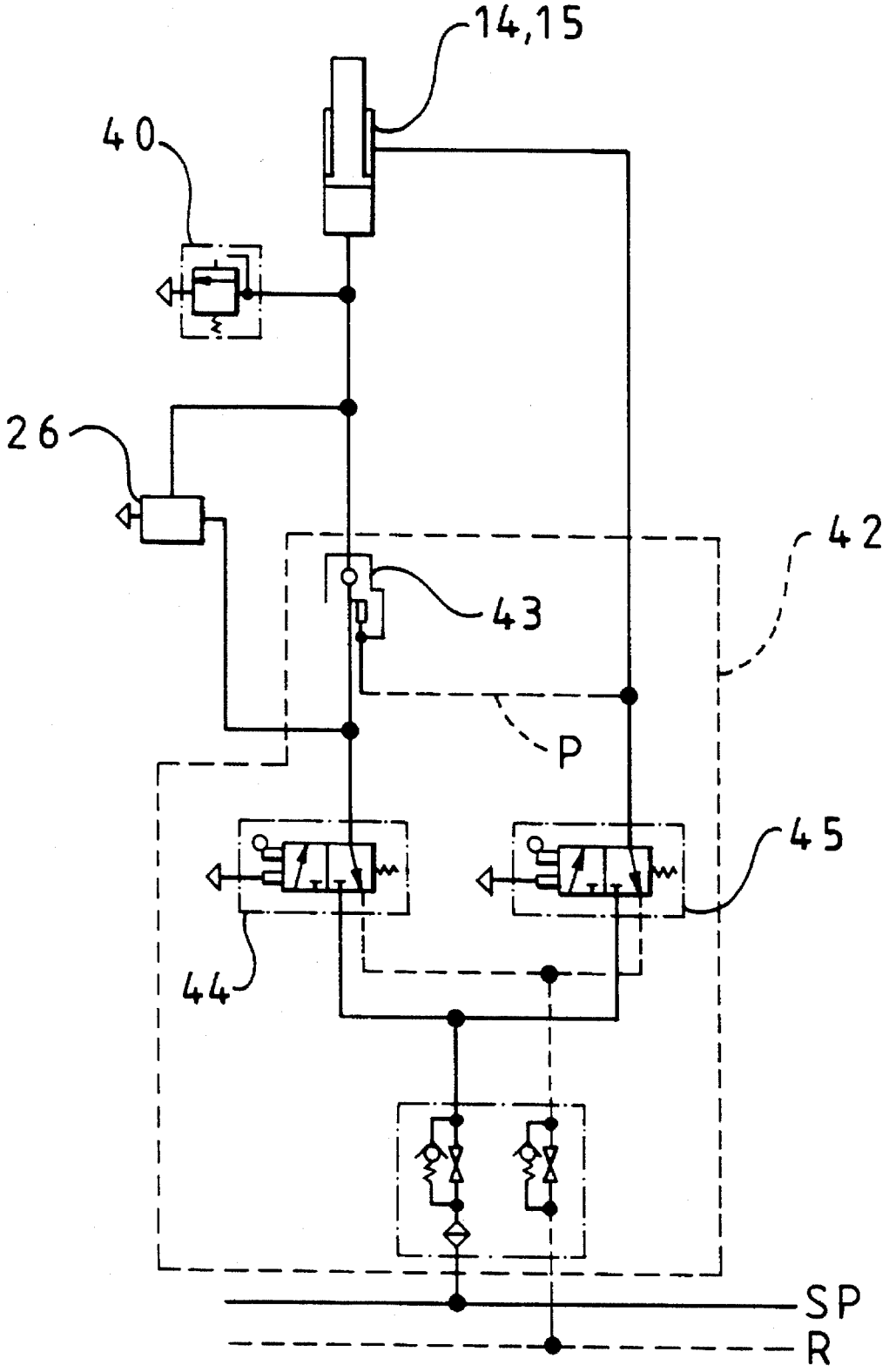

Referring now to FIG. 4, this shows an alternative hydraulic circuit for operating the prop 14, 15. This circuit can be used, the example, when the roof supports are advanced and set under electronic control. The circuit comprises a known valve arrangement 52 for selectively connecting the hydraulic prop 14, 15 to a source of pressurised fluid SP and to a fluid reservoir R. The valve arrangement 52 includes a pilot operated check valve 53 which functions as a non-return valve except when released by the application of pressure to a pilot line P. When setting the roof support, a set control valve 54 is held open, under electronic control, for long enough to ensure that the prop 14, 15 is set against the mine roof to (or substantially to) full system pressure. No guaranteed set valve is provided, and the yield valve 26 is connected across the check valve 53. A further control valve 55 can be held open, under electronic control, to supply pressure to the annulus of the prop and to apply a pilot signal to the check valve 53 to release the latter when it is required to lower the canopy 10.

The yield valve 26 of the circuit shown in FIG. 4 operates in similar manner to the yield valve of the circuit shown in FIG. 2, although the prop 14, 15 is set to full system pressure which may, in this case, be equivalent to the nominal yield pressure of the valve 26.

The above embodiments are given by way of example only and various modifications will be apparent to persons skilled in the art without departing from the scope of the invention. For example, the helical compression springs 44 and 45 could be replaced by a single helical compression spring or by one or more gas springs.

What is claimed is:

1. A yield valve comprising a valve body, a first inlet port, an outlet port, a valve seat, a valve member movable between a first position in which it co-operates with the valve seat to prevent fluid communication between the first inlet port and the outlet port and a second position in which the outlet port is brought into fluid communication with the first inlet port, one side of the valve member being in use subjected to the pressure of fluid at the first inlet port to urge the valve member towards its second position, spring means acting on the other side of the valve member to urge the valve member towards its first position, a valve chamber isolated from the first inlet port and from the outlet port, and a second inlet port for supplying a fluid under pressure to the valve chamber, the valve chamber being so arranged with respect to the valve member and the spring means that fluid pressure within the chamber will act on the valve member to urge the valve member towards its first position and will act on the spring means so as to reduce the force applied to the valve member by the spring means by an amount at least substantially equal to the force applied by the fluid pressure to the valve member.

2. A yield valve as claimed in claim 1, wherein the spring means comprises a spring loaded plunger movable relative to the valve body in a direction parallel to the direction of movement of the valve member and wherein a part of the valve member and a part of the spring loaded plunger extend into the chamber.

3. A yield valve as claimed in claim 2, wherein the valve member and plunger extend through respective openings in a wall of the valve chamber and sealing means sealingly supports the valve member and plunger for slidable movement in its respective opening, the plunger being in use exposed externally of the chamber to a relatively low reference pressure.

4. A yield valve as claimed in claim 2, wherein the area of the plunger exposed to fluid pressure in the valve chamber as measured in a plane normal to the direction of movement of the plunger is equal to the corresponding area of the valve member so that in use fluid pressure in the chamber will apply equal and opposite forces to the valve member and the plunger.

5. A yield valve as claimed in claim 2, wherein the area of the plunger exposed to fluid pressure in the valve chamber as measured in a plane normal to the direction of movement of the plunger is greater than the corresponding area of the valve member so that in use the force applied by fluid pressure in the valve chamber to the plunger will be greater than, and in an opposite direction to, the force applied to the valve member.

6. A yield valve as claimed in claim 2, wherein the plunger is spring loaded by one or more helical compression springs acting on the plunger via a force transmitting member externally of the valve chamber.

7. A yield valve as claimed in claim 2, wherein the spring means further comprises a spring in the valve chamber which spring applies a relatively weak force to the valve member by comparison to the full force applied to the valve member by the spring loaded plunger.

8. A yield valve as claimed in claim 1, wherein the valve member is in the form of a piston which is slidably mounted in the valve seat, the valve member having one or more holes in its surface which co-operates with the valve seat, the holes or holes being in communication with the first inlet port via a passage in the valve member.

9. A mine roof support comprising a roof engageable canopy, a floor engaging base section, prop means for raising and lowering the canopy relative to the base section and for setting the canopy against a mine roof, means for supplying hydraulic fluid under pressure to the prop means via a check valve (as defined herein), a yield valve as claimed in claim 1 means connecting the first inlet port of the yield valve to the hydraulic fluid supply means downstream of the check valve, and means connecting the second inlet port of the yield valve to the hydraulic fluid supply means upstream of the check valve.

10. A mine roof support comprising a roof engageable canopy, a floor engaging base section, prop means for raising and lowering the canopy relative to the base section and for setting the canopy against a mine roof, means for supplying hydraulic fluid to the prop means, a yield valve as claimed in claim 1, means connecting the hydraulic fluid supply means to the first inlet port of the yield valve and means for supplying a control pressure to the second inlet port of the yield valve.

11. A mine roof support comprising a roof engageable canopy, a floor engaging base section, prop means for raising and lowering the canopy relative to the base section and for setting the canopy against a mine roof, means for supplying hydraulic fluid under pressure to the prop means, and a yield valve having an outlet port through which fluid from the prop means can be released, a valve seat, a valve member movable between a first position in which it co-operates with the valve seat to prevent the release of fluid from the prop means via the outlet port and a second position in which fluid can be released from the prop means via the outlet port, means for subjecting one side of the valve member to the pressure of fluid in the prop means to urge the valve member towards its second position, spring means acting on the other side of the valve member to urge the valve member towards its first position, and means isolated from the outlet port for subjecting the other side of the valve member and the spring means to a pressurised fluid so that an increasing amount of the spring force applied to the valve member by the spring means is substituted by force applied to the other side of the valve member by the pressurised fluid as the latter increases.

* * * * *